US007815180B2

(12) United States Patent
Mezger et al.

(10) Patent No.: US 7,815,180 B2
(45) Date of Patent: Oct. 19, 2010

(54) DEVICE FOR MANUFACTURING THREAD-STITCHED BOOK BLOCKS WHICH COMPRISE FOLDED PRINTED SHEETS

(75) Inventors: Franz Konrad Mezger, Lauda-Königshofen (DE); Michael Robert Frank, Hardheim (DE)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/048,066

(22) Filed: Feb. 2, 2005

(65) Prior Publication Data

US 2005/0167902 A1 Aug. 4, 2005

(30) Foreign Application Priority Data

Feb. 3, 2004 (EP) ..... 04405071

(51) Int. Cl.
*B65H 37/04* (2006.01)

(52) U.S. Cl. ..... 270/52.29; 270/58.08; 270/52.18; 270/52.26

(58) Field of Classification Search ..... 270/52.26, 270/52.29

See application file for complete search history.

(56) References Cited

U.S. PATENT DOCUMENTS

| | | | | |
|---|---|---|---|---|
| 4,747,817 | A * | 5/1988 | Newsome | 493/438 |
| 5,690,324 | A * | 11/1997 | Otomo et al. | 270/58.02 |
| 6,095,740 | A * | 8/2000 | Hollenstein et al. | 412/4 |
| 6,270,068 | B1 * | 8/2001 | Cracknell | 270/52.26 |
| 6,581,753 | B1 * | 6/2003 | Brewster et al. | 198/470.1 |
| 2003/0214092 | A1 * | 11/2003 | Horii et al. | 270/52.18 |
| 2004/0046303 | A1 * | 3/2004 | Stolz | 270/1.01 |
| 2004/0065132 | A1 * | 4/2004 | Tschesche | 72/248 |

FOREIGN PATENT DOCUMENTS

| | | |
|---|---|---|
| EP | 0 537 106 B1 | 4/1993 |
| EP | 0 603 126 B1 | 6/1994 |
| EP | 0 893 275 A2 | 1/1999 |
| EP | 0 976 672 A2 | 2/2000 |
| EP | 1 013 470 A1 | 6/2000 |
| EP | 1 331 105 A2 | 7/2003 |

OTHER PUBLICATIONS

"Fadenheftmaschine Inventa-Hefttechnik mit kürzesten Fadenenden für höchste Ansprüche und Flexibilität," Müller Martini Marketing AG, Switzerland, pp. 1-7 (English language copy attached).

* cited by examiner

*Primary Examiner*—Gene Crawford
*Assistant Examiner*—Leslie A Nicholson, III
(74) *Attorney, Agent, or Firm*—Venable LLP; Robert Kinberg; Kyle D. Petaja

(57) ABSTRACT

A device for manufacturing thread-stitched book blocks which comprise folded printed sheets has a conveying apparatus which transports the printed sheets astride a stitching saddle into a stitching position and to which the printed sheets are fed. A stitching apparatus is arranged at a lateral spacing from the stitching saddle which can be driven in an oscillating manner and can be supplied with printed sheets by the stitching saddle. The conveying apparatus is controlled in order to change the conveying speed and/or the stitching position of the printed sheets on the stitching saddle, in that the conveying apparatus is drive-connected to a controlled-rotation electric motor which is controlled by a computer-connected controller.

9 Claims, 3 Drawing Sheets

DEVICE FOR MANUFACTURING THREAD-STITCHED BOOK BLOCKS WHICH COMPRISE FOLDED PRINTED SHEETS

CROSS-REFERENCE TO RELATED APPLICATION

This application claims the priority of European Patent Application No. 04405071.4-2304, filed on Feb. 3, 2004, the subject matter of which is incorporated herein by reference.

BACKGROUND OF THE INVENTION

The invention relates to a device for manufacturing thread-stitched book blocks which comprise folded printed sheets, the device having a conveying apparatus which transports the printed sheets astride a stitching saddle into a stitching position and being connected ahead of a feed apparatus for the printed sheets. Such device further has a stitching apparatus which is arranged at a lateral spacing from the stitching saddle and which can be driven in an oscillating manner transversely with respect to the conveying direction of the printed sheets which are transported by the conveying apparatus. The stitching apparatus can be supplied with printed sheets by the stitching saddle and the conveying apparatus is controlled so that the conveying speed and/or the stitching position of the printed sheets on the stitching saddle can be changed or can be adapted to the different properties of the printed sheets.

Devices of this type are known in thread-stitching machines for manufacturing thread-stitched book blocks; for example, in a thread-stitching machine INVENTA from Muller Martini Buchbindesysteme AG. Here, the printed sheets are gripped individually at the delivery end of the likewise saddle-shaped feed apparatus by the conveying apparatus which is assigned to the stitching saddle, and the printed sheets are displaced on the stitching saddle into a stitching position. As soon as the printed sheet has reached the stitching position, the frictional connection is released between the belts of the conveying apparatus which transport the printed sheet on the stitching saddle, and the stitching saddle is pivoted with the printed sheet into the stitching position of the stitching apparatus.

This largely inelastic drive connection to the transport means for the printed sheets does not permit precise positioning of the printed sheets on the stitching saddle which are defined for a book block, and the reliability and the accuracy suffers as a result when the printed sheets approach one another. A further impediment is that the properties of the different printed sheets which are defined for a book block, be they with regard to weight, thickness and/or quality of the material (for example paper), etc., tend towards an irregular behavior during the transfer from the feed apparatus onto the stitching saddle, for example by different slippage of the printed sheets in the conveying direction.

Because control can be lost over printed sheets, they recoil from stops or do not reach their stitching position on the stitching saddle.

In a device according to European Patent document EP 1 013 470 A1, the conveying belts of the conveying apparatus are fastened to the laterally movable stitching saddle, whereas the conveying apparatus is arranged at a fixed position in the above-mentioned thread-stitching machine INVENTA.

In both known devices, the printed sheets are gripped after the feed apparatus by the conveying apparatus which is assigned to the stitching saddle, and the printed sheets are preferably accelerated in the conveying direction, with the result that they are removed in time from the drivers of the feed apparatus, in order to be braked against a stop before they reach the stitching position, in order that a hard impact can be avoided.

Efforts have been made up to now to achieve this aim with a mechanical apparatus, but it can be achieved only imprecisely on account of the great variability of the formats and weights of the printed sheets and different friction conditions or different properties of the printed sheets which follow one another. Exact positioning has also not been achieved in the known manner. It is possible that the problem can be lessened by the costly exchange of control cams, but it cannot be completely prevented.

SUMMARY OF THE INVENTION

It is an object of the present invention to provide a device with which the listed faults are largely eliminated.

The above and other objects are achieved in an apparatus of the type first described above, wherein according to the invention, the conveying apparatus is drive-connected to a controlled-rotation electric motor which is controlled by a computer-connected controller.

The result is a simple drive device for the conveying apparatus, for accurate and flexible positioning of the printed sheets on the stitching saddle.

Furthermore, the device according to the invention is distinguished by the fact that all printed-sheet formats can be displaced into the defined stitching position with an approximately identical drive force.

Damage to the printed sheets is prevented and it is possible to avoid smearing of the printing ink because of a frictional loss in the conveying apparatus.

A time advantage can also be achieved for the stitching operation by this procedure.

The controller is advantageously connected to a computer which has a data storage medium in which data corresponding to the format of different printed sheets are stored, can be called up and can be coupled to the controller of the electric motor, as a result of which the conveying apparatus can be set or adjusted in a simple manner to a defined format size.

The conveying speed of the printed sheets towards the stitching position can advantageously be decelerated to zero by the controller in a metered manner, with the result that the printed sheets can be positioned on the stitching saddle gently and exactly.

In the interests of high production output and reliability, it can be expedient to accelerate the conveying speed of the printed sheets by the controller prior to deceleration, with the result that the printed sheets cannot be damaged by drivers of the feed apparatus.

In a simple manner, the stitching position of the printed sheets on the stitching saddle can be assigned a stop which determines the end position of a printed sheet, the printed sheets being aligned with the stop by their leading edge.

As an alternative or in addition, the stitching position on the stitching saddle can be assigned a sensor which determines the end position of a printed sheet and is connected to the computer in order to transmit a signal.

The stop and/or the sensor can advantageously be fastened to be adjustable in the conveying direction of the printed sheets, with the result that, inter alia, stitching positioning can be performed which can be corrected with respect to the stitching apparatus.

The device can have a conveying apparatus which comprises two circulating belts which form a conveying nip for the printed sheets via working sections.

It goes without saying that it would also be possible for driven rollers which are arranged next to one another in the conveying direction of the printed sheets to be provided instead of belts, in order to form a conveying apparatus or a conveying nip.

DETAILED DESCRIPTION OF THE DRAWINGS

In the following text, the invention will be explained using an exemplary embodiment and with regard to the drawing to which reference is made with respect to all the details which are not mentioned in greater detail in the description.

DETAILED DESCRIPTION OF THE INVENTION

Figure 1:
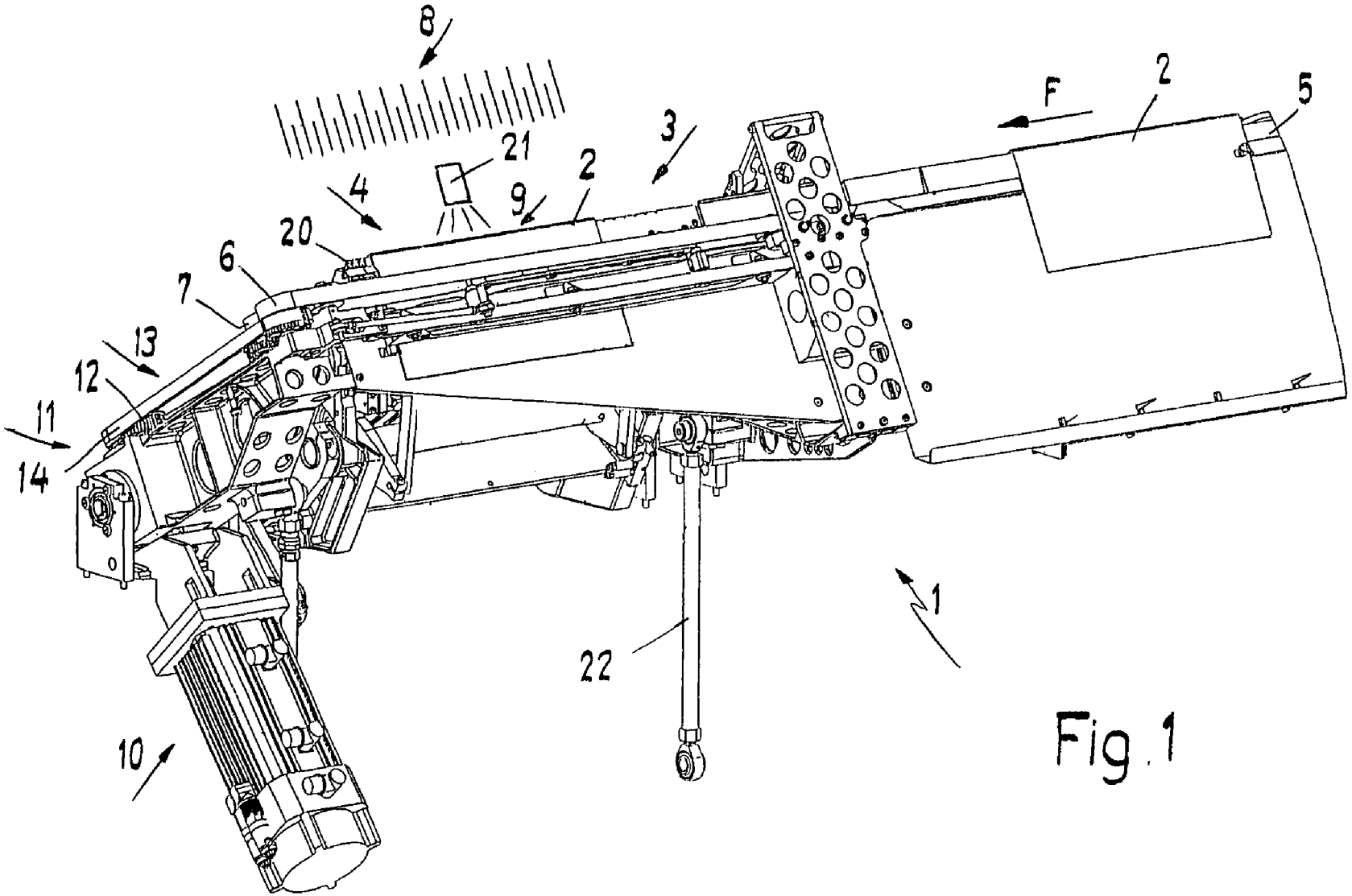
FIG. 1 shows a detail of a three-dimensional illustration of a refinement of the device according to the invention for a thread stitching machine.

FIG. 1 shows a device 1 for a thread-stitching machine for manufacturing thread-stitched book blocks which comprise folded printed sheets 2, having a conveying apparatus 4 which transports the printed sheets 2 astride a stitching saddle 3 into a stitching position. Before the printed sheets 2 which are determined for a book block in a defined order are transferred to an upstream deliverer 5, they are collected loosely to form book blocks in a collating machine and subsequently transferred into a cassette of a printed-sheet feeder (not visible) which is assigned to the deliverer 5. This procedure is known and not part of the present device according to the invention. This known procedure and the principles of thread stitching can be found in the relevant literature, for example publications or the book "Industrielle Buchbinderei" [Industrial Bookbinding] by Liebau/Heinze, Verlag Beruf+Schule.

The printed sheets 2 are placed astride the deliverer 5 and are transported further synchronously in the conveying direction F by a circulating flexible drive element (not visible) to which drivers are fastened which act on the printed sheets in a jogging manner.

The device 1 (also known as an insertion device) which adjoins the deliverer 5 in a stepless manner in the conveying direction F and is of gable-roof-shaped design in cross section grips and transports the printed sheets 2 arriving from the deliverer 5 by means of the conveying apparatus 4, which is formed by two adjacent circulating conveying belts, into a stitching position which corresponds to the stitching position of the printed sheet 2 in a stitching apparatus 8 arranged to the side of the conveying apparatus.

The stitching apparatus 8 is shown diagrammatically by stitching needles (a perforating needle and a hook needle usually form a stitching-needle pair) and the stitching procedure is described, for example, in European Patent documents EP-B-0 537 106 and 0 603 126.

Before the printed sheet 2 has reached the final stitching position on the stitching saddle 3 of the device 1 shown and is situated, for example, in the position illustrated, the stitching saddle 3 begins to move into the stitching position on the front side of the printed sheets which are stitched in the stitching apparatus 8 to form book blocks.

The stitching saddle 3 approaches the stitching apparatus 8, in a manner driven by the rod 22, by means of a pivoting movement of the stitching saddle 3 about an axis which extends parallel to the conveying direction F. In or before the approached end position of the stitching saddle 3, a front (as seen in the feed direction of the printed sheets 2) saddle section which can therefore be lifted out, is activated, which saddle section displaces the printed sheet 2 into the stitching position at the stitching apparatus.

The printed sheet 2 which has been placed onto a partial book block on the saddle section 9 is stitched; the stitching needles start to act and the saddle section 9 is displaced back into the initial position in the device 1 by a controller (not shown).

The stitching saddle 3 which has been moved back after the restoring-stroke signal and the saddle section 9 are subsequently located in the initial position in which they can receive the next printed sheet 2 arriving from the deliverer 5.

After the stitching procedure has finished and a further printed sheet 2 has been fastened to the book block, the next printed sheet 2 reaches the stitching saddle 3 on the deliverer 5.

Figure 2:
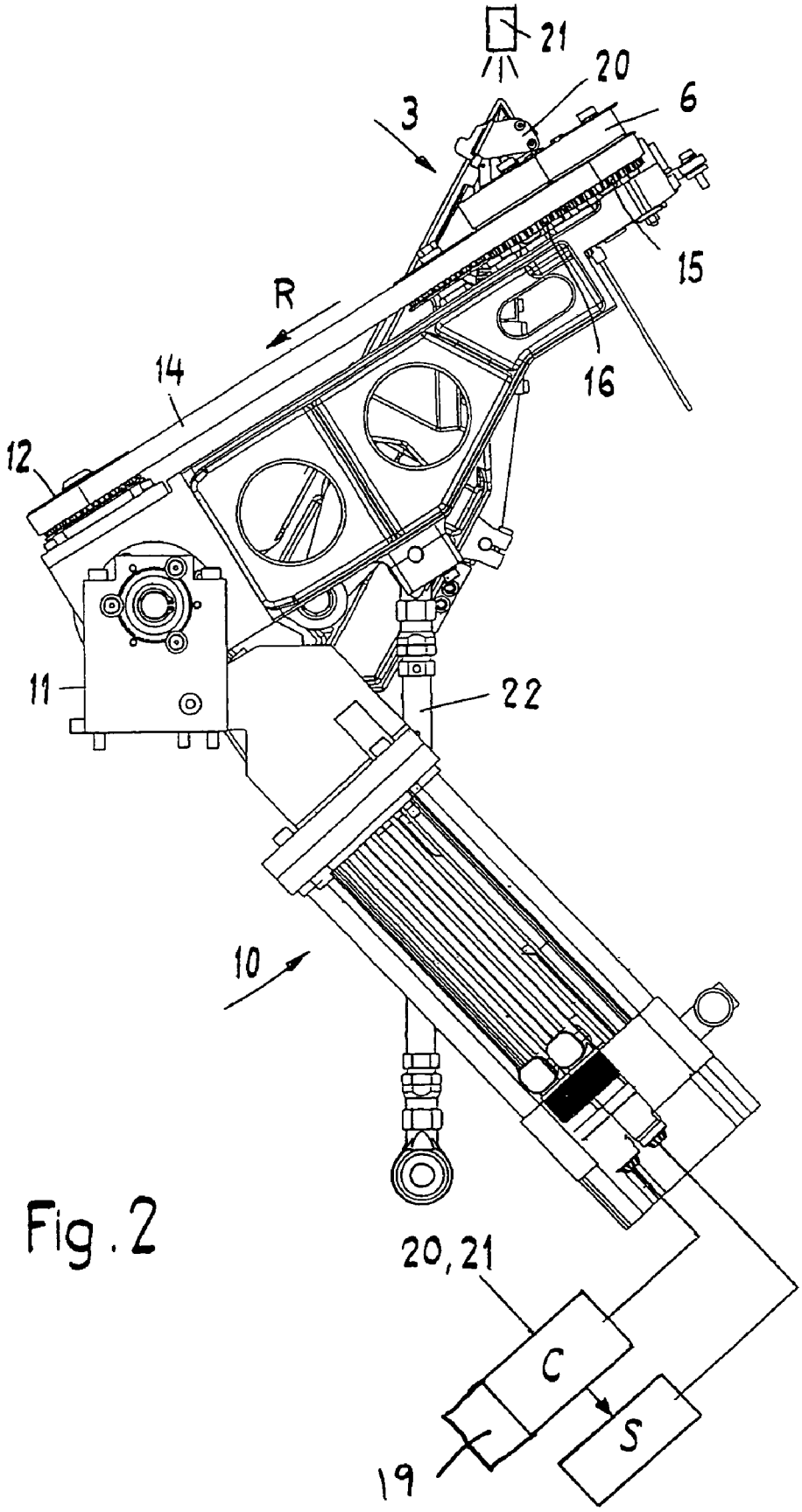
FIG. 2 shows a side view of the device shown in FIG. 1.
Figure 3:
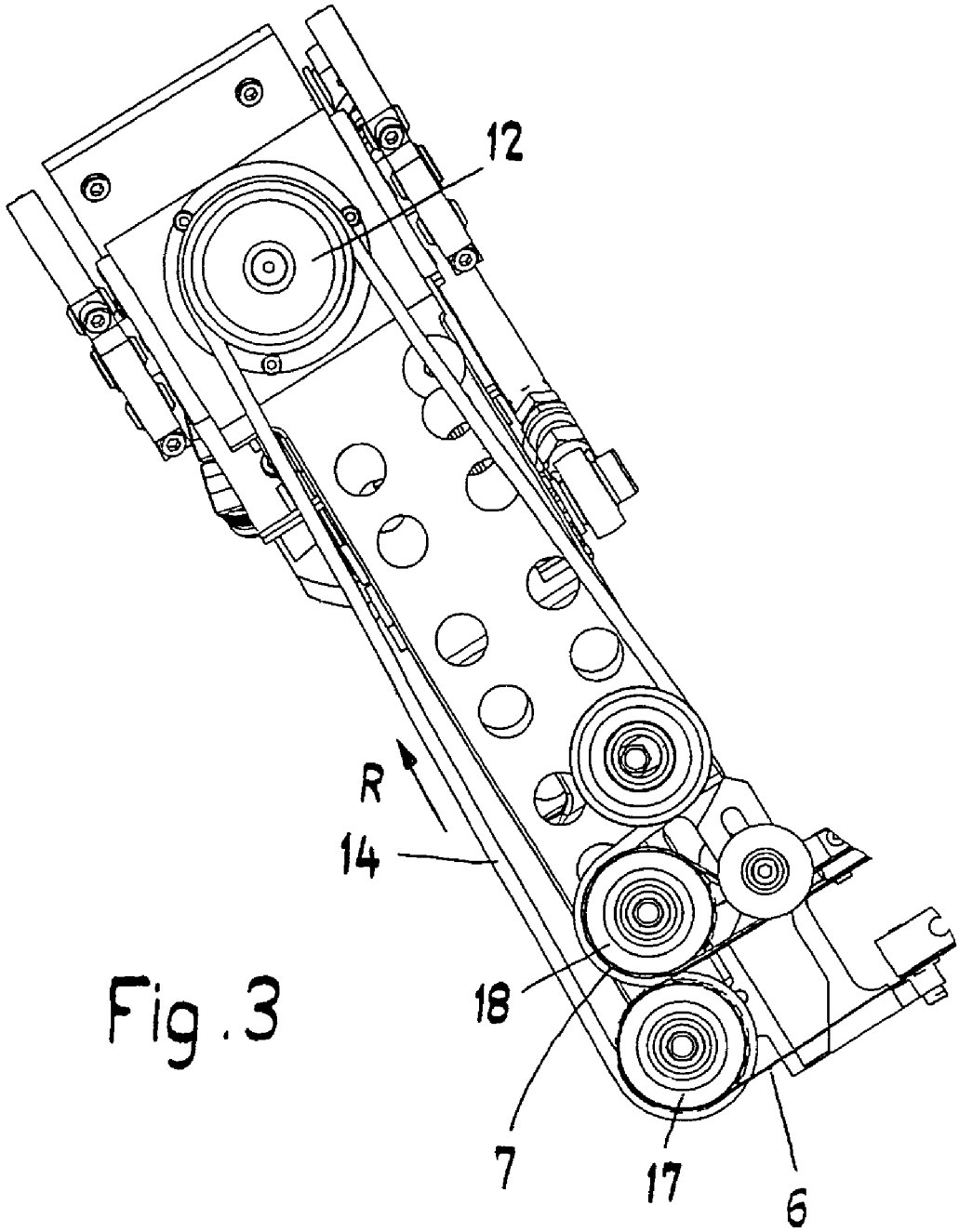
FIG. 3 shows a plan view of the device illustrated in FIG. 2.

FIG. 1 furthermore shows the stitching apparatus 8 and a controlled-rotation electric motor 10 which is provided for driving the conveying apparatus 4 and is flange-connected to a machine frame. A drive shaft (not visible) penetrates a bearing housing 11 of a drive sprocket 12 of a belt reduction gear 13 whose double-toothed drive belt 14 meshes with drive sprockets 15, 16 of the conveying belts 6, 7 which circulate around rollers 17, 18 and form the conveying apparatus 4 (cf. also FIGS. 2 and 3). A controller S of the controlled-rotation electric motor 10 is connected to a computer C which has a data storage medium 19 and from which the conveying apparatus 4 can be controlled manually or automatically according to stored programs.

It is, for example, possible to store an individual programmed processing procedure or one which is repeated during manufacture in the computer C and to perform it using the conveying apparatus 4 via the controller S.

Here, if required, the conveying speed or the stitching position of the printed sheets can be changed in adaptation to an end stop 20 and/or a sensor 21 on the stitching saddle 3 or also adapted to new circumstances.

The deceleration of the conveying speed and/or the acceleration of the conveying speed of the printed sheets can also be affected by a correction of the conveying speed or the stitching position on the stitching saddle 3, signalized by the stop 20 or the sensor 21. For example, necessary corrections can be performed automatically or manually via the computer C if a printed sheet strikes the stop 20 too hard or does not reach the stop which defines the stitching position, as well as when it passes the sensor 21.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for manufacturing thread-stitched book blocks comprised of folded printed sheets, the device comprising:

a stitching saddle;

a feed apparatus for the printed sheets;

a conveying apparatus disposed on the stitching saddle and arranged to receive printed sheets from the feed apparatus and transport the printed sheets in a conveying direction astride the stitching saddle into a stitching position;

a stitching apparatus arranged at a lateral spacing from the stitching saddle, wherein the stitching saddle is driven in an oscillating manner transversely with respect to the conveying direction of the printed sheets transported by the conveying apparatus, wherein the stitching apparatus is supplied with printed sheets by the stitching saddle, wherein the conveying apparatus is controlled so that at least one of the conveying speed or the stitching position of the printed sheets on the stitching saddle can be changed or adapted to different properties of the printed sheet, wherein the printed sheets are transported by the conveying apparatus to the stitching position on the stitching saddle while the stitching saddle is driven in an oscillating manner, wherein the conveying apparatus includes a toothed-belt reduction gear, two circulating conveying belts which form a conveying nip via working sections, and adjacent deflection rollers having drive sprockets operatively arranged with the respective conveying belts, wherein the toothed-belt reduction gear comprises a double toothed belt that is drive-connected to the drive sprockets of the adjacent deflection rollers;

a computer-connected controller; and a controlled rotation electric motor, wherein the controlled rotation electric motor is controlled by the computer-connected controller and is drive connected to the conveying apparatus via the toothed-belt reduction gear.

2. The device according to claim 1, further including a computer connectable to the controller and having a data storage medium in which data which correspond to the format of different printed sheets are stored.

3. The device according to claim 1, wherein the controller is operable for decelerating the conveying speed of the printed sheets towards the stitching position at least approximately to zero.

4. The device according to claim 1, further including a stop which determines the end position of a printed sheet and which in turn determines the stitching position on the stitching saddle.

5. The device according to claim 4, wherein at least one of the stop or a sensor is or are fastened to be adjustable in the conveying direction of the printed sheets.

6. The device according to claim 1, further comprising a sensor aimed at the stitching saddle to determine the end position or stitching position of a printed sheet on the stitching saddle and having an output coupled to the computer.

7. A device for manufacturing thread-stitched book blocks comprised of folded printed sheets, the device comprising:

a stitching saddle;

a feed apparatus for the printed sheets;

a conveying apparatus disposed on the stitching saddle and arranged to receive printed sheets from the feed apparatus and transport the printed sheets in a conveying direction astride the stitching saddle into a stitching position;

a stitching apparatus arranged at a lateral spacing from the stitching saddle, wherein the stitching saddle is drivable in an oscillating manner transversely with respect to the conveying direction of the printed sheets transported by the conveying apparatus, wherein the stitching apparatus is supplied with printed sheets by the stitching saddle, wherein the conveying apparatus is controlled so that at least one of the conveying speed or the stitching position of the printed sheets on the stitching saddle can be changed or adapted to different properties of the printed sheet, wherein the printed sheets are transported by the conveying apparatus to the stitching position on the stitching saddle while the stitching saddle is driven in an oscillating manner, wherein the conveying apparatus includes a toothed-belt reduction gear, two circulating conveying belts which form a conveying nip via working sections, and adjacent deflection rollers having drive sprockets operatively arranged with the respective conveying belts, wherein the toothed-belt reduction gear comprises a double toothed belt that is drive-connected to the drive sprockets of the adjacent deflection rollers;

a computer;

a sensor aimed at the stitching saddle to determine the stitching position of a printed sheet on the stitching saddle and having an output coupled to the computer;

a computer-connected controller, wherein the controller is operable to accelerate the conveying speed of the printed sheets towards the stitching position and to decelerate the conveying speed of the printed sheets at least approximately to zero after acceleration; and a controlled rotation electric motor, wherein the controlled rotation electric motor is controlled by the computer-connected controller and is drive connected to the conveying apparatus via the toothed-belt reduction gear.

8. A method for manufacturing thread-stitched book blocks comprised of folded printed sheets, the method comprising:

feeding a printed sheet to a stitching saddle;

transporting the printed sheet in a conveying direction astride the stitching saddle to a stitching position via a conveying apparatus disposed on the stitching saddle, wherein the conveying apparatus includes a toothed-belt reduction gear, two circulating conveying belts which form a conveying nip via working sections, and adjacent deflection rollers having drive sprockets operatively arranged with the respective conveying belts, wherein the toothed-belt reduction gear comprises a double toothed belt that is drive-connected to the drive sprockets of the adjacent deflection rollers, controlling the conveying apparatus by a controller coupled to a computer, wherein the conveying apparatus is drive connected to a controlled rotation electric motor via the toothed-belt reduction gear determining the presence of the printed sheet at a stitching position on the stitching saddle via a sensor aimed at the stitching saddle, wherein the sensor is coupled to the computer;

transmitting a signal from the sensor to the computer indicating the presence of the printed sheet at the stitching position on the stitching saddle; and transmitting a signal from the computer to the controller stopping the conveying apparatus such that the printed sheet remain in the stitching position.

9. The method of claim 8, further comprising:

Controlling the conveying apparatus by the controller such that at least one of the conveying speed or the stitching position of the printed sheet on the stitching saddle is changed or adapted to different properties of the printed sheet.

* * * * *